US006941931B2

(12) United States Patent
Watanabe et al.

(10) Patent No.: US 6,941,931 B2
(45) Date of Patent: Sep. 13, 2005

(54) FUEL INJECTION SYSTEM FOR INTERNAL COMBUSTION ENGINE

(75) Inventors: Tsuguo Watanabe, Saitama (JP); Tomomi Yuhara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 74 days.

(21) Appl. No.: 10/645,600

(22) Filed: Aug. 22, 2003

(65) Prior Publication Data

US 2004/0065302 A1 Apr. 8, 2004

(30) Foreign Application Priority Data

Sep. 3, 2002 (JP) ..... 2002-258212

(51) Int. Cl.[7] ..... F02D 41/34
(52) U.S. Cl. ..... 123/478; 123/492
(58) Field of Search ..... 123/478, 480, 123/491, 492

(56) References Cited

U.S. PATENT DOCUMENTS 4,242,992 A * 1/1981 Kawamura et al. ..... 123/478
4,825,834 A * 5/1989 Toshimitsu et al. ..... 123/478
5,775,282 A * 7/1998 Smith ..... 123/179.8

FOREIGN PATENT DOCUMENTS

JP 10-196440 A 7/1998

* cited by examiner

*Primary Examiner*—Tony M. Argenbright
(74) *Attorney, Agent, or Firm*—Birch, Stewart, Kolasch & Birch, LLP

(57) ABSTRACT

A fuel injection system for an internal combustion engine has an upstream fuel injector provided upstream from the throttle valve and a downstream fuel injector provided downstream therefrom. A device is provided for determining a fuel injection quantity of the upstream and downstream fuel injectors. A sensor detects the intake temperature TA on the upstream side from an injection area of the upstream fuel injector. A device is provided for seeking an intake temperature correction factor KTA on the basis of the intake temperature TA and a fuel injection quantity of the upstream fuel injector. At least one of the fuel injection quantities due to the upstream and downstream fuel injectors is corrected on the basis of the intake temperature correction factor KTA.

18 Claims, 6 Drawing Sheets

| | Cne00 | Cne01 | | Cnei | | Cne14 |
|---|---|---|---|---|---|---|
| Cth0 | Rupper (0,0) | Rupper (1,0) | | Rupper (i,0) | | Rupper (14,0) |
| Cth1 | : | : | | : | | : |
| Cth2 | : | : | | : | | : |
| : | : | : | | : | | : |
| Cthj | Rupper (0,j) | Rupper (1,j) | | Rupper (i,j) | | Rupper (14,j) |
| : | : | : | | : | | : |
| Cth7 | : | : | | : | | : |
| Cth8 | : | : | | : | | : |
| Cth9 | Rupper (0,9) | Rupper (1,9) | | Rupper (i,9) | | Rupper (14,9) |

FIG.3

FUEL INJECTION SYSTEM FOR INTERNAL COMBUSTION ENGINE

CROSS-REFERENCE TO RELATED APPLICATIONS

This nonprovisional application claims priority under 35 U.S.C. § 119(a) on Patent Application No. 2002-258212, filed in Japan on Sep. 3, 2002, the entirety of which is incorporated herein by reference.

BACKGROUND OF THE INVENTION

1. Field of the Invention

The present invention relates to a fuel injection system for an internal combustion engine. More particularly, the present invention relates to a fuel injection system in which injection valves have been provided on the upstream side and on the downstream side thereof, respectively, with a throttle valve interposed therebetween.

2. Description of Background Art

When the fuel injector is provided upstream from the throttle valve, the volumetric efficiency is improved because heat is taken from intake air when injection fuel vaporizes. Therefore, the engine output can be increased as compared with when the fuel injector is provided downstream from the throttle valve. On the other hand, when the fuel injector is provided on the upstream side, a distance between the fuel injection port of the upstream fuel injector and the combustion chamber inevitably increases. Accordingly, a response lag occurs in fuel transport as compared with when the fuel injector is provided downstream from the throttle valve. This causes the driveability of the engine to deteriorate.

In Japanese Patent Laid-Open Nos. 4-183949 and 10-196440, it has been attempted to solve such technical problems, to improve engine output and to ensure that driveability is compatible with the engine output. In the above documents, a fuel injection system has been disclosed in which fuel injectors have been provided on the upstream side and on the downstream side from the intake pipe, respectively, with the throttle valve interposed therebetween.

FIG. 7 is a cross-sectional view showing a major portion of an internal combustion engine according to the background art in which two fuel injectors have been arranged with a throttle valve 52 of an intake pipe 51 interposed therebetween. A downstream fuel injector 50*a* has been arranged on a side portion of the downstream side (engine side) of the throttle valve 52 and an upstream fuel injector 50*b* has been arranged on the upstream side (air cleaner side) of the throttle valve 52. A lower end portion of the intake pipe 51 is connected to an intake passage 52. An intake port 53 faces a combustion chamber of the intake passage 52 and is opened and closed by an intake valve 54.

The fuel injection quantity of each fuel injector is determined with plural parameters including the throttle opening as a function. However, volumetric efficiency within the combustion chamber is dependent on the intake temperature. Accordingly, an electronic controlled fuel injection system detects the intake temperature TA to control in such a manner that the injection quantity is relatively reduced as the intake temperature TA becomes higher.

The intake temperature TA is preferably detected immediately before the combustion chamber. However, when a temperature sensor is provided at the portion concerned, the intake efficiency of an air-fuel mixture into the combustion chamber is deteriorated. Accordingly, in an engine in which two fuel injectors are arranged, the temperature sensor is often provided on the upstream side from the fuel injection area of the upstream fuel injector 50*b*.

However, the air within the intake pipe is cooled by the fuel injected from the upstream fuel injector 50*b*. Accordingly, a difference occurs between the intake temperature to be detected by the temperature sensor and the intake temperature immediately before the combustion chamber. This causes problems in detecting the correct intake temperature TA.

SUMMARY OF THE INVENTION

It is an object of the present invention to solve the above-described problems of the background art. Specifically, it is an object to provide a fuel injection system for an internal combustion engine capable of supplying an optimum quantity of fuel for a particular intake temperature, in a structure in which fuel injectors are arranged on the upstream side and on the downstream side of the throttle valve, respectively.

In order to achieve the above-described object, there is provided a fuel injection system for an internal combustion engine according to the present invention having an intake pipe equipped with a throttle valve, an upstream fuel injector provided upstream from the throttle valve and a downstream fuel injector provided downstream from the throttle valve. Means are provided for determining the fuel injection quantity of the upstream and downstream fuel injectors. Means are provided for detecting intake temperature TA on the upstream side from an injection area of the upstream fuel injector. Means are provided for determining an intake temperature correction factor KTA on the basis of the intake temperature TA and the fuel injection quantity of the upstream fuel injector. In addition, means are provided for correcting at least one of the fuel injection quantities due of the upstream and downstream fuel injectors on the basis of the intake temperature correction factor KTA.

According to the above-described feature, the intake temperature correction factor KTA can be determined as a function of the fuel injection quantity of the upstream fuel injector. Accordingly, if it is arranged in such a manner that the intake temperature correction factor KTA becomes relatively large as the fuel injection quantity of the upstream fuel injector increases, a drop in the intake temperature due to upstream fuel injection will be properly compensated for. Therefore, it becomes possible to supply an optimum quantity of fuel for a particular intake temperature.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a view showing one example of an injection rate table;

DETAILED DESCRIPTION OF THE PREFERRED EMBODIMENTS

Figure 1:
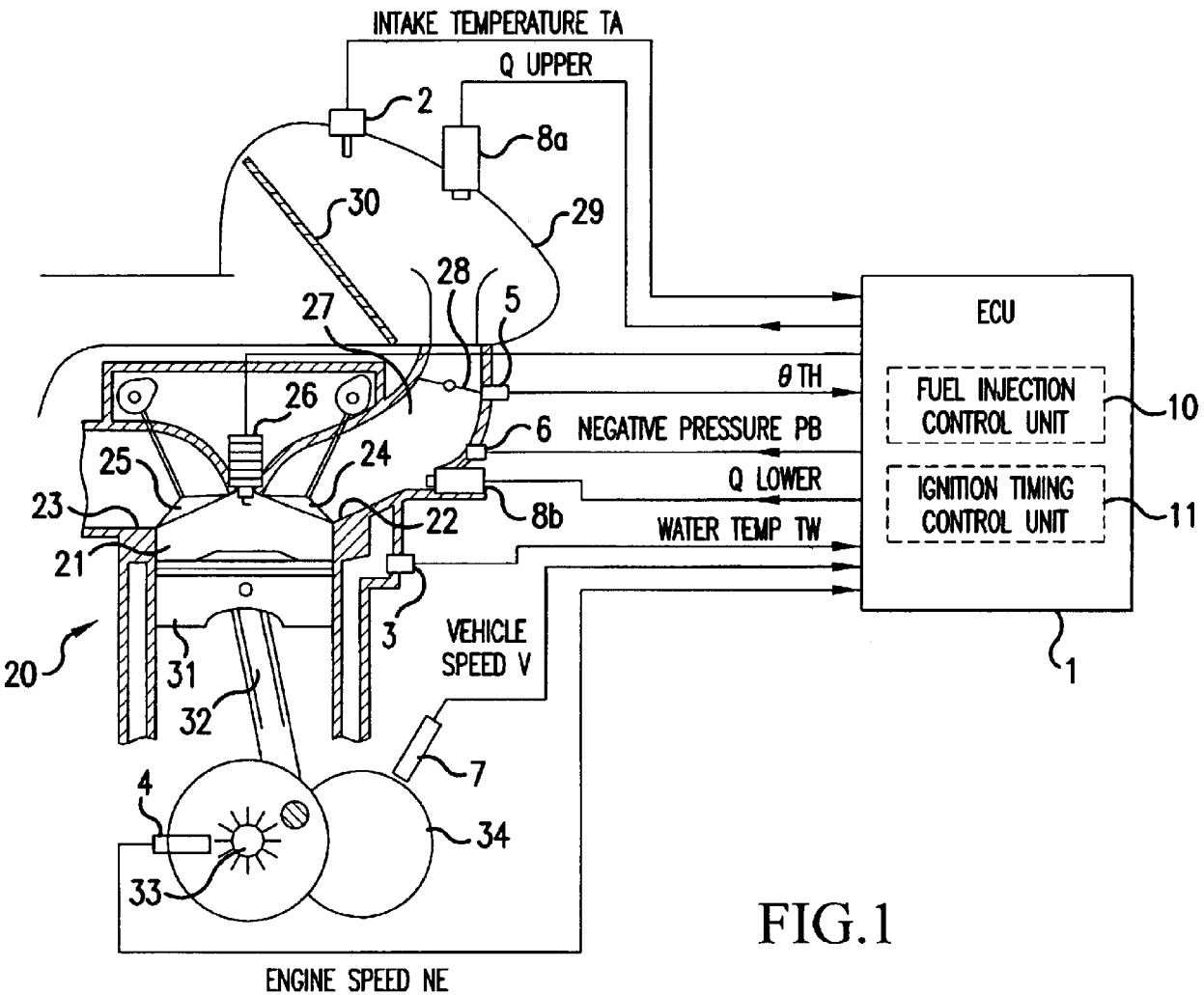
FIG. 1 is a general block diagram showing a fuel injection system according to one embodiment of the present invention.

Hereinafter, the present invention will be described with reference to the accompanying drawings. It should be noted that the same reference numerals have been used throughout the several views to identify the same or similar elements. FIG. 1 is a general block diagram showing a fuel injection system according to one embodiment of the present invention. An intake port 22 and an exhaust port 23 open into a combustion chamber 21 of the engine 20. Each port 22 and 23 is provided with an intake valve 24 and an exhaust valve 25, respectively. In addition, an ignition plug 26 is provided extending into the combustion chamber 21.

A throttle valve 28 for adjusting intake air quantity in accordance with an opening θTH thereof, a throttle sensor 5 for detecting the opening θTH and a vacuum sensor 6 for detecting intake manifold vacuum PB are provide on an intake passage 27 leading to the intake port 22. An air cleaner 29 is provided at a terminal of the intake passage 27. An air filter 30 is provided within the air cleaner 29. Open air is taken into the intake passage 27 through the air filter 30.

A downstream injection valve 8*b* is arranged in the intake passage 27 downstream from the throttle valve 28. An upstream injection valve 8*a* is arranged on the air cleaner 29 upstream from the throttle valve 28 so as to point to the intake passage 27. An intake temperature sensor 2 is provided for detecting intake (atmospheric) temperature TA.

An engine speed sensor 4 is provided opposite to a crankshaft 33, which is coupled to a piston 31 of the engine 20 through a connecting rod 32, for detecting the engine speed NE on the basis of a rotation angle of a crankshaft 33. Furthermore, a vehicle speed sensor 7 is arranged opposite to a rotor 34, such as a gear which is coupled to the crankshaft 33 for rotation, for detecting vehicle speed V. A water temperature sensor 3 is provided on a water jacket formed around the engine 20 for detecting cooling water temperature TW representing the engine temperature.

An ECU (Engine Control Unit) 1 includes a fuel injection control unit 10 and an ignition timing control unit 11. The fuel injection control unit 10 outputs, on the basis of signals (process values) obtained from each of the above-described sensors, injection signals Qupper and Qlower of each injection valve 8*a*, 8*b* on the upstream and downstream sides. Each of these injection signals is a pulse signal having pulse width responsive to the injection quantity. Each injection valve 8*a*, 8*b* is opened for a time corresponding to the pulse width to inject the fuel. The ignition timing control unit 11 controls the ignition timing of the ignition plug 26.

Figure 2:
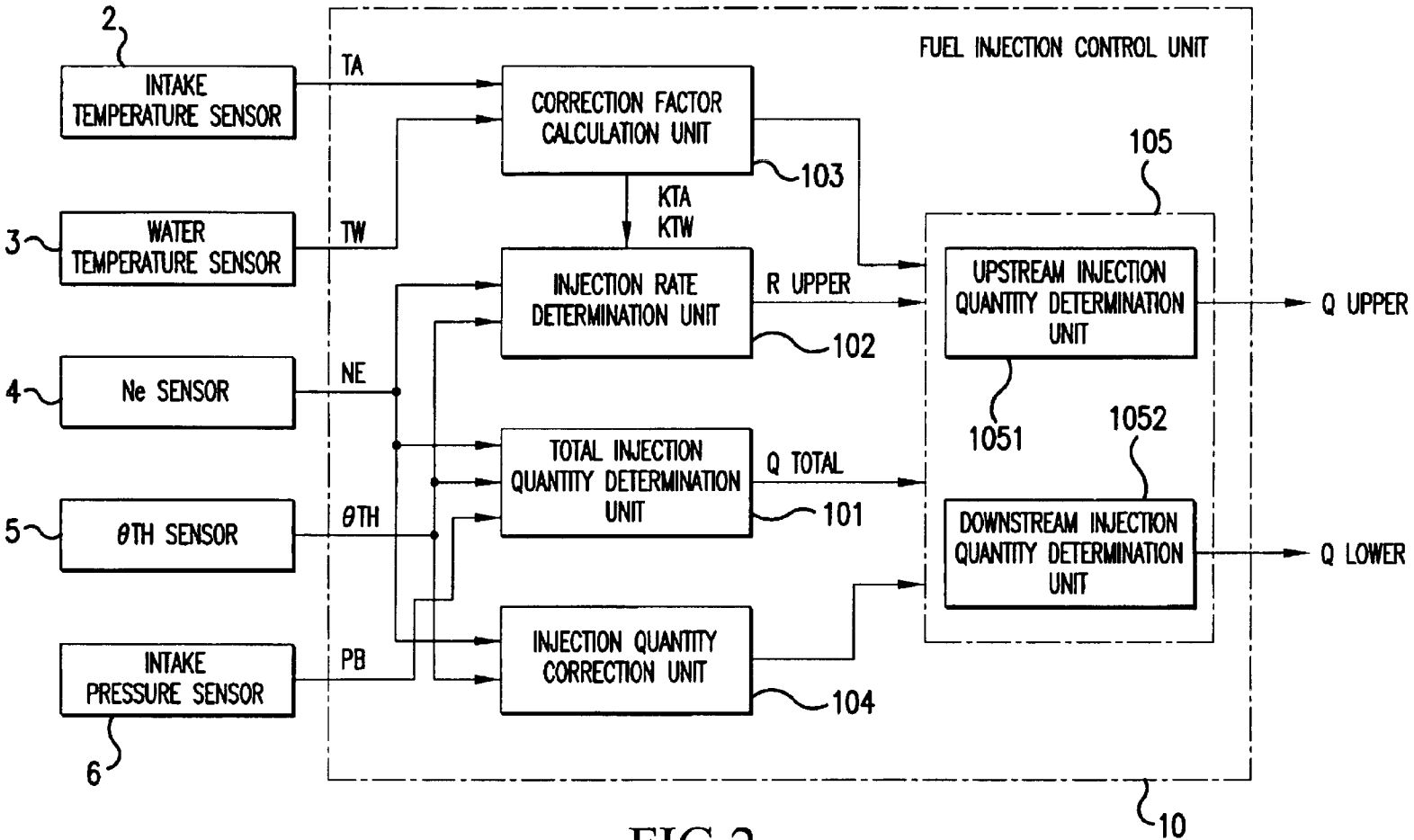
FIG. 2 is a functional block diagram for a fuel injection control unit 10.

FIG. 2 is a functional block diagram for the fuel injection control unit 10. A total injection quantity determination unit 101 determines a total quantity Qtotal of fuel to be injected from each fuel injector 8*a*, 8*b* on the upstream and downstream sides on the basis of the engine speed NE, the throttle opening θTH and intake pressure PB. An injection rate determination unit 102 refers to an injection rate table on the basis of the engine speed NE and throttle opening θTH to determine an injection rate Rupper of the upstream injection valve 8*a*. An injection rate Rlower of the downstream injection valve 8*b* is determined as (1-Rupper).

FIG. 3 is a view showing an example of the injection rate table. In the present embodiment, an injection rate map includes 15 items (Cne00 to Cne14) as a reference for the engine speed NE and 10 items (Cth0 to Cth9) as a reference for the throttle opening θTH. The injection rate Rupper of the upstream injection valve 8*a* is registered in advance at each combination of engine speed NE and the throttle opening θTH. The injection rate determination unit 102 determines an injection rate Rupper corresponding to the engine speed NE and the throttle opening θTH that have been detected by means of a four-point interpolation of the injection rate map.

Referring again to FIG. 2, a correction factor calculation unit 103 refers to a data table on the basis of the intake temperature TA and the cooling water temperature TW that have been detected to seek various correction factors including an intake temperature correction factor KTA and a cooling water temperature correction factor KTW.

Figure 4:
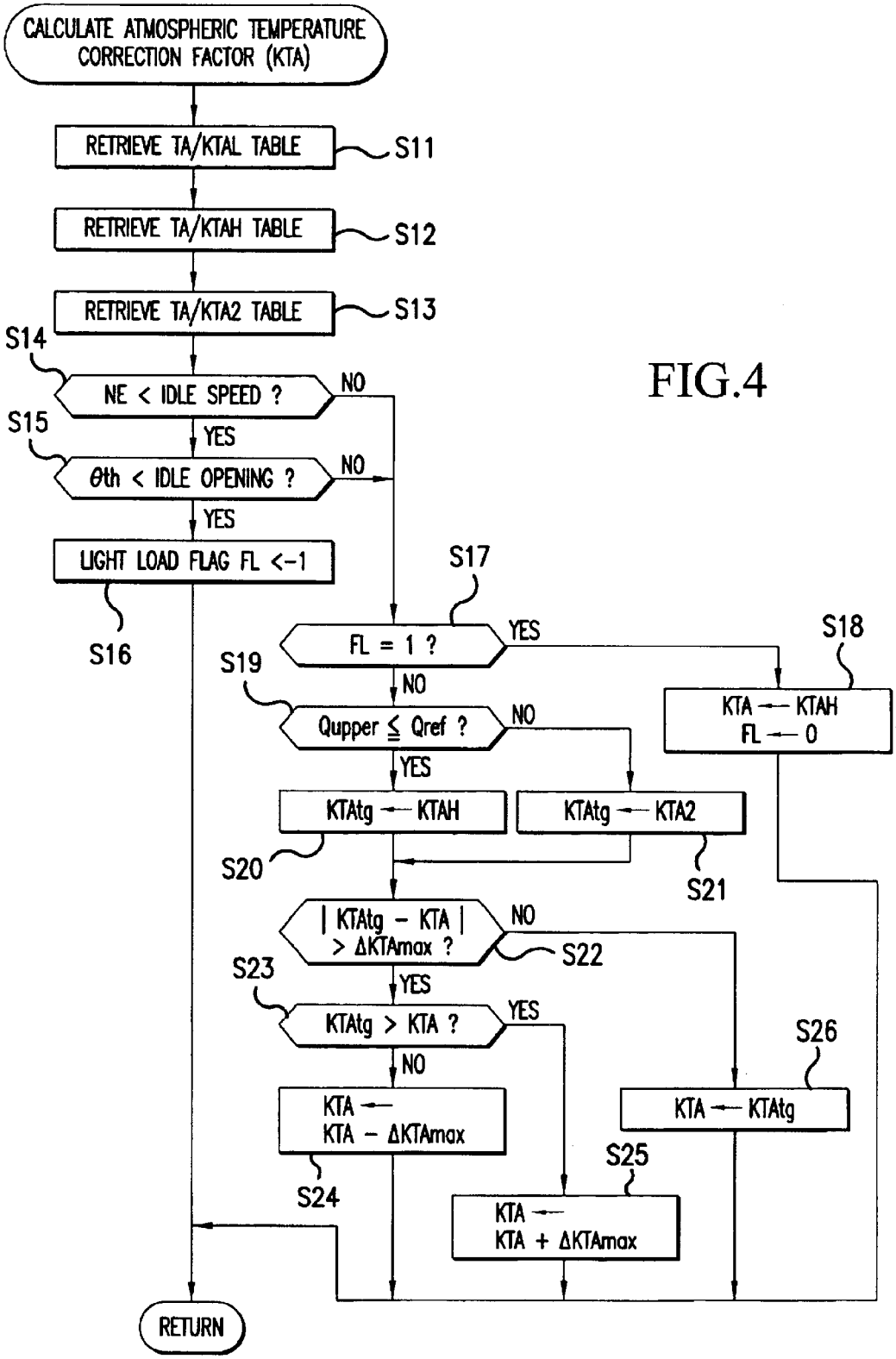
FIG. 4 is a flowchart showing a calculation procedure of a correction factor KTA.

Referring to the flowchart of FIG. 4, a description will now be made in detail of a calculation method for the intake temperature correction factor KTA according to the present embodiment.

In a step S11, a TA/KTAL table to be described later is referred to and a correction factor KTAL for a light load corresponding to the intake temperature TA is calculated. In a step S12, a TA/KTAH table to be described later is referred to, and a correction factor KTAH for a heavy load corresponding to the intake temperature TA is calculated. In a step S13, a TA/KTA2 table to be described later is referred to, and a correction factor KTA2 for upstream and downstream injection corresponding to the intake temperature TA is calculated.

Figure 5:
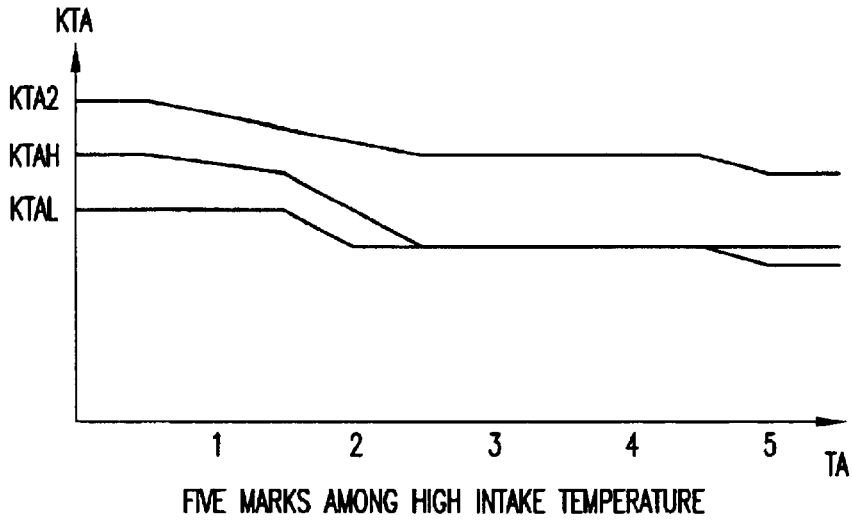
FIG. 5 is a view showing an example of an intake temperature correction factor table.

FIG. 5 is a view showing the contents of each of the above-described tables schematically and superimposed. For each intake temperature TA, each correction factor KTAL, KTAH and KTA2 corresponding thereto has been registered. In the present embodiment, each correction factor for the intake temperature TA has been selected so as to indicate a tendency of KTAL<KTAH<KTA2. A relationship between the intake temperature TA and each correction factor has been registered only with nine items of the intake temperature TA. Any other relationship can be determined by interpolation.

Referring again to FIG. 4, in a step S14, the engine speed NE is compared with a predetermined reference speed. In the present embodiment, the engine speed NE is compared with an idle speed. When the engine speed NE becomes lower than the idle speed, the sequence will proceed to a step S15. In the step S15, the throttle opening θth is compared with a predetermined reference opening. In the present embodiment, the throttle opening θth is compared with the idle opening. When the throttle opening θth becomes lower than the idle opening, the sequence will proceed to a step S16. In the step S16, the correction factor for a light load KTAL determined in the step S11 will be adopted as the intake temperature correction factor KTA. A light load flag FL will be set.

On the other hand, when either of the steps S14, S15 is negative, the sequence will proceed to a step S17 to refer to the light load flag FL. If the light load flag FL has been set, the sequence will proceed to a step S18, and the correction factor for a heavy load KTAH determined in the step S12 will be adopted as the intake temperature correction factor KTA. The light load flag FL will then be reset.

In the step S17, if the light load flag FL has not been set, the sequence will proceed to a step S19. An upstream injection quantity Qupper which is determined by an upstream injection quantity determination unit 1051 to be described later will be compared with a predetermined reference injection quantity Qref. If Qupper≦Qref, the sequence will proceed to a step S20 because a drop in intake temperature due to the upstream injection is low. A correction factor for a heavy load KTAH determined in the step S12 will be registered to a target correction factor KTAtg. In contrast to this, if Qupper>Qref, the sequence will proceed to a step S21 because a drop in the intake temperature due to the upstream injection becomes high. A correction factor for upstream and downstream injection KTA2 determined in the step S13 will be registered to the target correction factor KTAtg.

In a step S22, a differential between the target correction factor KTAtg and the present intake temperature correction factor KTA is determined. The differential is compared with the maximum correction quantity ΔKTAmax. If the differential is smaller than the maximum correction quantity ΔKTAmax, the target correction factor KTAtg will be adopted as the intake temperature correction factor KTA in a step S26.

In contrast to this, if the differential is larger than the maximum correction quantity ΔKTAmax, the sequence will proceed to a step S23 to compare the target correction factor KTAtg with the present intake temperature correction factor KTA. If the target correction factor KTAtg is smaller than the intake temperature correction factor KTA, in a step S24, a value obtained by deducting the maximum correction quantity ΔKTAmax from the present intake temperature correction factor KTA will be adopted as a new intake temperature correction factor KTA. If the target correction factor KTAtg is larger than the intake temperature correction factor KTA, in a step S25, a sum of the present intake temperature correction factor KTA and the maximum correction quantity ΔKTAmax will be adopted as a new intake temperature correction factor KTA.

As described above, in the present embodiment, the intake temperature correction factor is switched depending on the injection quantity due to the upstream injection valve. Accordingly, it becomes possible to accurately control the fuel injection even if the intake temperature varies in response to the injection quantity of the upstream injection valve.

Referring again to FIG. 2, the injection quantity correction unit 104 corrects the injection quantity of each injection valve 8*a*, 8*b* during acceleration, when the throttle opening θth is abruptly closed and at other times. In the injection quantity determination unit 105, the upstream injection quantity determination unit 1051 determines a basic injection quantity of the upper injection valve 8*a* on the basis of the injection rate Rupper and the total injection quantity Qtotal, and multiplies this basic injection quantity by various correction factors including the correction factor KTA, KTW to determine the injection quantity Qupper of the upstream injection valve 8*a*. A downstream injection quantity determination unit 1052 determines the injection quantity Qlower of the downstream injection valve 8*b* on the basis of the upstream injection quantity Qupper and the total injection quantity Qtotal.

Figure 6:
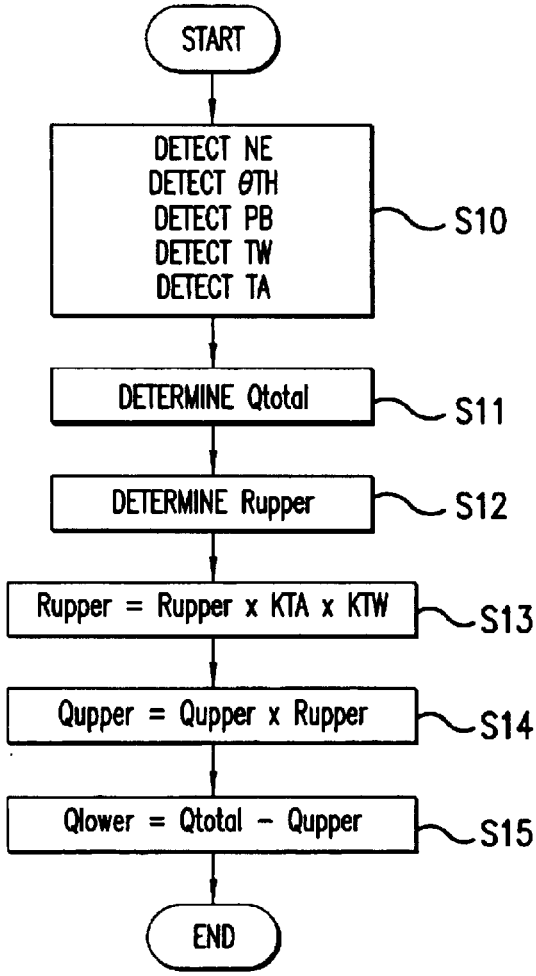
FIG. 6 is a flowchart showing a control procedure of fuel injection.
Figure 7:
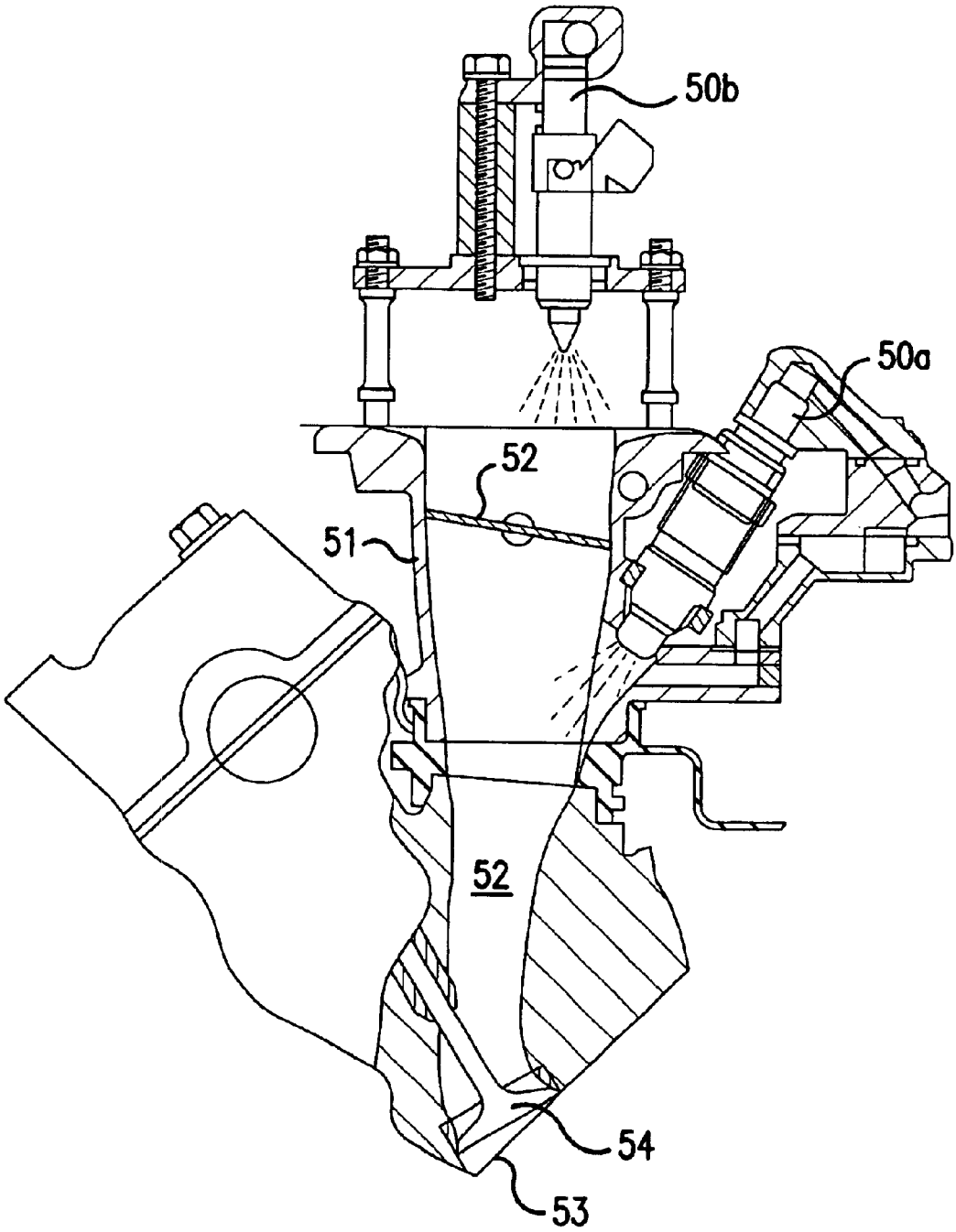
FIG. 7 is a cross-sectional view showing an internal combustion engine according to the background art in which two fuel injectors have been arranged.

Referring to the flowchart of FIG. 6, a description will now be made in detail of an operation of the fuel injection control unit 10. This handling is executed by interruption due to a crank pulse in a predetermined stage.

In a step S10, the engine speed NE, the throttle opening θTH, the manifold air pressure PB, the intake temperature TA and the cooling water temperature TW are detected by each of the above-described sensors. In a step S11, in the total injection quantity determination unit 101, total quantity Qtotal of fuel to be injected from each fuel injector 8*a*, 8*b* on the upstream side and on the downstream side is determined on the basis of the engine speed NE, the throttle opening θTH and the intake pressure PB.

In a step S12, in the injection rate determination unit 102, an injection rate table is referred to on the basis of the engine speed Ne and the throttle opening θTH. An injection rate Rupper of the upstream injection valve 8*a* is determined. In a step S13, the injection rate Rupper is corrected on the basis of the following expression (1):

$$\text{Rupper}=\text{Rupper}\times KTW\times KTA \tag{1}$$

In a step S14, the upstream injection quantity determination unit 1051 calculates an injection quantity Qupper of the upstream injection valve 8*a* on the basis of the following expression (2):

$$\text{Qupper}=\text{Qtotal}\times\text{Rupper} \tag{2}$$

In a step S15, the downstream injection quantity determination unit 1052 calculates the injection quantity Qlower of the downstream injection valve 8*b* on the basis of the following expression (3):

$$\text{Qlower}=\text{Qtotal}-\text{Qupper} \tag{3}$$

When the injection quantity Qupper of the upstream injection valve 8*a* and the injection quantity Qlower of the downstream injection valve 8*b* are determined as described above, an injection signal having a pulse width responsive to each of the injection quantity Qupper, Qlower is outputted to each injection valve 8*a*, 8*b* at predetermined timing synchronized to the crank angle to inject fuel from each injection valve 8*a*, 8*b*.

In this respect, in the above-described embodiment, the description has been made of a case where the injection quantity of the upstream injection valve 8*a* is reduced when the throttle valve is at low temperature. However, the injection may be completely stopped.

According to the present invention, the intake temperature correction factor KTA can be determined as a function of the fuel injection quantity of the upstream fuel injector. Accordingly, if it is arranged in such a manner that the intake temperature correction factor KTA becomes relatively large as the fuel injection quantity of the upstream fuel injector increases, a drop in the intake temperature due to upstream fuel injection will be properly compensated for. Therefore, it becomes possible to supply an optimum quantity of fuel for a particular intake temperature.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection system for an internal combustion engine having an intake pipe equipped with a throttle valve, an upstream fuel injector provided upstream from the throttle valve and a downstream fuel injector provided downstream from the throttle valve, said fuel injection system comprising:

means for determining fuel injection quantities of the upstream and the downstream fuel injectors;

means for detecting an intake temperature (TA) on the upstream side from an injection area of the upstream fuel injector;

means for determining an intake temperature correction factor (KTA) on the basis of said intake temperature (TA) and the fuel injection quantity of one of the upstream and the downstream fuel injectors; and means for correcting at least one of said fuel injection quantities of the upstream and downstream fuel injectors on the basis of said intake temperature correction factor (KTA).

2. The fuel injection system for an internal combustion engine according to claim 1, wherein said intake temperature correction factor (KTA) is determined irrespective of said fuel injection quantity of the upstream fuel injector under a light load of the engine.

3. The fuel injection system for an internal combustion engine according to claim 1, wherein said intake temperature correction factor (KTA) becomes relatively high as the fuel injection quantity of the upstream fuel injector increases.

4. The fuel injection system for an internal combustion engine according to claim 1, wherein said intake temperature correction factor (KTA) is determined on the basis of said intake temperature (TA) and the fuel injection quantity of the upstream fuel injector.

5. The fuel injection system for an internal combustion engine according to claim 1, said means for determining said intake temperature correction factor (KTA) further comprises means for calculating a correction factor for a light load (KTAL) corresponding to the intake temperature (TA), a correction factor for a heavy load (KTAH) corresponding to the intake temperature (TA) and a correction factor for upstream and downstream injection (KTA2) corresponding to the intake temperature (TA).

6. The fuel injection system for an internal combustion engine according to claim 4, said means for determining said intake temperature correction factor (KTA) further comprises means for calculating a correction factor for a light load (KTAL) corresponding to the intake temperature (TA), a correction factor for a heavy load (KTAH) corresponding to the intake temperature (TA) and a correction factor for upstream and downstream injection (KTA2) corresponding to the intake temperature (TA).

7. The fuel injection system for an internal combustion engine according to claim 5, wherein when a throttle opening and an idle speed of the engine are less than a predetermined value, said intake temperature correction factor (KTA) will be set to said correction factor for a light load (KTAL).

8. The fuel injection system for an internal combustion engine according to claim 6, wherein when a throttle opening and an idle speed of the engine are less than a predetermined value, said intake temperature correction factor (KTA) will be set to said correction factor for a light load (KTAL).

9. The fuel injection system for an internal combustion engine according to claim 7, wherein when a throttle opening or an idle speed of the engine are greater than a predetermined value, said intake temperature correction factor (KTA) will be adjusted, depending on said intake temperature (TA) and the fuel injection quantity of the upstream fuel injector.

10. A method of injecting fuel for an internal combustion engine having an intake pipe equipped with a throttle valve, an upstream fuel injector provided upstream from the throttle valve and a downstream fuel injector provided downstream from the throttle valve, said method comprising the steps of:

determining fuel injection quantities of the upstream and the downstream fuel injectors;

detecting an intake temperature (TA) on the upstream side from an injection area of the upstream fuel injector;

determining an intake temperature correction factor (KTA) on the basis of said intake temperature (TA) and the fuel injection quantity of one of the upstream and the downstream fuel injectors; and correcting at least one of said fuel injection quantities of the upstream and downstream fuel injectors on the basis of said intake temperature correction factor (KTA).

11. The method according to claim 10, wherein said intake temperature correction factor (KTA) is determined irrespective of said fuel injection quantity of the upstream fuel injector under a light load of the engine.

12. The method according to claim 10, wherein said intake temperature correction factor (KTA) becomes relatively high as the fuel injection quantity of the upstream fuel injector increases.

13. The method according to claim 10, wherein said intake temperature correction factor (KTA) is determined on the basis of said intake temperature (TA) and the fuel injection quantity of the upstream fuel injector.

14. The method according to claim 10, said means for determining said intake temperature correction factor (KTA) further comprises means for calculating a correction factor for a light load (KTAL) corresponding to the intake temperature (TA), a correction factor for a heavy load (KTAH) corresponding to the intake temperature (TA) and a correction factor for upstream and downstream injection (KTA2) corresponding to the intake temperature (TA).

15. The method according to claim 13, said means for determining said intake temperature correction factor (KTA) further comprises means for calculating a correction factor for a light load (KTAL) corresponding to the intake temperature (TA) a correction factor for a heavy load (KTAH) corresponding to the intake temperature (TA) and a correction factor for upstream and downstream injection (KTA2) corresponding to the intake temperature (TA).

16. The method according to claim 14, wherein when a throttle opening and an idle speed of the engine are less than a predetermined value, said intake temperature correction factor (KTA) will be set to said correction factor for a light load (KTAL).

17. The method according to claim 15, wherein when a throttle opening and an idle speed of the engine are less than a predetermined value, said intake temperature correction factor (KTA) will be set to said correction factor for a light load (KTAL).

18. The method according to claim 16, wherein when a throttle opening or an idle speed of the engine are greater than a predetermined value, said intake temperature correction factor (KTA) will be adjusted, depending on said intake temperature (TA) and the fuel injection quantity of the upstream fuel injector.

* * * * *